US011667982B2

(12) United States Patent
Zhu et al.

(10) Patent No.: US 11,667,982 B2
(45) Date of Patent: Jun. 6, 2023

(54) LONG-LIFE SERVICE METHOD FOR POWDER-BOTTOM-INJECTING CONVERTER BASED ON COLLABORATIVE HOT REPLACEMENT OF FURNACE BOTTOM AND BOTTOM PURGING BRICK

(71) Applicants: University of Science and Technology Beijing, Beijing (CN); Soochow University, Suzhou (CN)

(72) Inventors: Rong Zhu, Beijing (CN); Shaoyan Hu, Suzhou (CN); Kai Dong, Beijing (CN); Rongfang Su, Beijing (CN); Weifeng Li, Beijing (CN)

(73) Assignees: University of Science and Technology Beijing, Beijing (CN); Soochow University, Suzhou (CN)

( * ) Notice: Subject to any disclaimer, the term of this patent is extended or adjusted under 35 U.S.C. 154(b) by 0 days.

(21) Appl. No.: 17/476,501

(22) Filed: Sep. 16, 2021

(65) Prior Publication Data

US 2022/0235427 A1 Jul. 28, 2022

(30) Foreign Application Priority Data

Jan. 26, 2021 (CN) ..... 202110103152.4

(51) Int. Cl.
*C21C 5/46* (2006.01)
*C21C 5/48* (2006.01)
(Continued)

(52) U.S. Cl.
CPC ..... *C21C 5/4606* (2013.01); *C21C 5/30* (2013.01); *C21C 5/48* (2013.01); *F27D 3/16* (2013.01);
(Continued)

(58) Field of Classification Search
CPC ..... C21C 5/4606; C21C 5/30; C21C 5/48; F27D 3/16
(Continued)

(56) References Cited

U.S. PATENT DOCUMENTS 3,330,645 A * 7/1967 Edouard ..... C21C 5/34 75/557
3,802,684 A * 4/1974 Rote ..... C21C 5/48 266/268
(Continued)

FOREIGN PATENT DOCUMENTS

CN 106702073 * 5/2017 ..... C21C 5/48
CN 109234490 A 1/2019
(Continued)

*Primary Examiner* — Scott R Kastler
*Assistant Examiner* — Michael Aboagye
(74) *Attorney, Agent, or Firm* — Bayramoglu Law Offices LLC

(57) ABSTRACT

A long-life service method for powder-bottom-injecting converter based on collaborative hot replacement of furnace bottom and bottom purging brick belongs to the field of steelmaking technologies using powder-bottom-injecting converters. According to equipment characteristics, process characteristics, and erosion characteristics of the powder-bottom-injecting converter, the design, arrangement, installation, use, maintenance, and replacement of the bottom purging/powder injection bricks are systematically optimized and improved, a technology of automatically detecting the erosion height of bottom purging bricks is adopted,
(Continued)

and hot replacement of bottom purging/powder injection bricks and hot replacement of the converter furnace bottom are used collaboratively, which not only can prolong the service life of a single bottom purging/powder injection brick, but also can greatly prolong the overall life of the powder-bottom-injecting converter from 1000-3000 heats in the prior art to 6000-10000 heats. Hence, the life of the powder-bottom-injecting converter is as long as that of a conventional converter.

4 Claims, 4 Drawing Sheets

(51) Int. Cl.
*F27D 3/16* (2006.01)
*C21C 5/30* (2006.01)

(52) U.S. Cl.
CPC .. *F27D 2003/164* (2013.01); *F27D 2003/168* (2013.01)

(58) Field of Classification Search
USPC ... 266/83, 81, 216, 265, 267, 253, 221, 224, 266/225
See application file for complete search history.

(56) References Cited

U.S. PATENT DOCUMENTS

| | | | | | |
|---|---|---|---|---|---|
| 3,829,960 | A * | 8/1974 | Hubble | C04B 35/03 | 266/283 |
| 3,839,017 | A * | 10/1974 | Schempp | C21C 5/35 | 75/530 |
| 3,912,243 | A * | 10/1975 | Chang | C21C 5/4606 | 266/218 |
| 10,808,290 | B2 * | 10/2020 | Zhu | C21C 7/0025 | |
| 10,988,818 | B2 * | 4/2021 | Zhu | C21C 5/38 | |

FOREIGN PATENT DOCUMENTS

| | | | | |
|---|---|---|---|---|
| CN | 208562438 U | | 3/2019 | |
| JP | H07316624 | * | 12/1995 | C21C 5/48 |

* cited by examiner

LONG-LIFE SERVICE METHOD FOR POWDER-BOTTOM-INJECTING CONVERTER BASED ON COLLABORATIVE HOT REPLACEMENT OF FURNACE BOTTOM AND BOTTOM PURGING BRICK

CROSS REFERENCE TO THE RELATED APPLICATIONS

This application is based upon and claims priority to Chinese Patent Application No. 202110103152.4, filed on Jan. 26, 2021, the entire contents of which are incorporated herein by reference.

TECHNICAL FIELD

The present application relates to the field of steelmaking technologies using powder-bottom-injecting converters, and particularly relates to a long-life service method for powder-bottom-injecting converter based on collaborative hot replacement of furnace bottom and bottom purging brick.

BACKGROUND

Converter steelmaking is currently one of the most important steelmaking methods in the world. Conventional converter steelmaking adopts top-blowing supersonic oxygen jets and low-flow-rate bottom inert gas purging. The lime required for steelmaking is all introduced through the converter mouth in the form of blocks. Due to the low mixing strength of the molten pool and the slow slag formation of the lime blocks of this converting method, the metallurgical reaction kinetics conditions of the conventional converter steelmaking are poor, resulting in high consumption of raw and auxiliary materials and poor purity of molten steel. The method not only increases the cost of steelmaking, but also affects the quality of molten steel.

Compared with the above-mentioned conventional converter steelmaking, the powder-bottom-injecting converter is an advanced steelmaking method in which oxidizing gas is used as the carrier gas to inject the lime required for steelmaking directly into the molten bath from the converter furnace bottom in the form of powder. The bottom purging and stirring intensity of this converter steelmaking method is much higher than the above-mentioned conventional converter, and the direct injection of the oxidizing gas and powder into the molten bath also significantly increases the gas-solid-liquid three-phase reaction interface area and improves the metallurgical reaction kinetic conditions, which can improve the purity of steel while reducing the consumption of raw and auxiliary materials for steelmaking, and smelt low-carbon, low-phosphorus, low-oxygen, and low-nitrogen pure molten steel with high efficiency and low costs. Obviously, the powder-bottom-injecting converter has a better metallurgical effect than the conventional converter.

However, for a long time, steelmaking using powder-bottom-injecting converters has not been applied in large-scale production. The fundamental reason is that the bottom blowing of oxidizing gas and powder will bring about the technical defects of high temperature, high oxidation and severe erosion of the powder-bottom-injecting converter furnace bottom, which accelerates the erosion of the converter furnace bottom and shortens the service life. Prolonging the life of the powder-bottom-injecting converter is crucial to the promotion of the large-scale application of this advanced steelmaking process.

At present, the lance used in powder-bottom-injecting converters is a dual-layer sleeve structure, where the inner tube is a powder transport pipe configured to transport a high-pressure and high-speed powder flow, and the channel between the inner tube and the outer tube is an annular gap pipe. Cooling protective gas is purged inside the annular gap pipe, and the lance is wrapped with a refractory material to make a bottom purging/powder injection brick. During steelmaking using powder-bottom-injecting converters, the service conditions around the bottom purging/powder injection brick are the worst, with the fastest erosion speed, leading to the gradual formation of an inverted cone-shaped pit centered on the bottom purging/powder injection brick.

However, under existing technical conditions, once the deepest part of the inverted cone-shaped pit reaches or even exceeds the lower safety limit of the converter furnace bottom, the converter has to end the campaign and be reconstructed in order to prevent steel leakage. As a result, the actual life of the powder-bottom-injecting converter is far lower than that of a conventional converter, making it difficult to promote the large-scale application of powder-bottom-injecting converters.

SUMMARY

The technical problem to be solved by the present application solve is that during steelmaking using powder-bottom-injecting converters, an inverted cone-shaped pit centered on the bottom purging/powder injection brick is gradually formed, and once the deepest part of the inverted cone-shaped pit reaches or even exceeds the lower safety limit of the converter furnace bottom, the converter has to end the campaign and be reconstructed in order to prevent steel leakage. As a result, the actual life of the powder-bottom-injecting converter is far lower than that of a conventional converter, making it difficult to promote the large-scale application of powder-bottom-injecting converters.

To solve the above technical problems, the present application proposes a long-life service method for powder-bottom-injecting converter based on collaborative hot replacement of furnace bottom and bottom purging brick, with reference to the practical experience of the powder-bottom-injecting converter projects that have been carried out in the early stage. According to equipment characteristics, process characteristics, and erosion characteristics of the powder-bottom-injecting converter, the design, arrangement, installation, use, maintenance, and replacement of the bottom purging/powder injection bricks are systematically optimized and improved, a technology of automatically detecting the erosion height of bottom purging bricks is adopted, and hot replacement of bottom purging/powder injection bricks and hot replacement of the converter furnace bottom are used collaboratively, thereby achieving the long-life service of the powder-bottom-injecting converter.

The following technical solutions are adopted in the present application:

A long-life service method based on collaborative hot replacement of powder-bottom-injecting converter furnace bottom and bottom purging brick, characterized in that, the powder-bottom-injecting converter furnace bottom is a plurality of independently removable and replaceable converter furnace bottoms; during construction of the powder-bottom-injecting converter furnace bottom, a first converter furnace bottom is selected, N groups of bottom purging base bricks are pre-constructed on the first converter furnace bottom, and the N groups of bottom purging base bricks are solid; after the construction, the first converter furnace bottom is assembled to a converter body, and then oxygen-blown steelmaking is carried out using a top-blowing oxygen lance with a high Mach number and small inclination angle;

after a refractory material of the first converter furnace bottom is properly sintered, each bottom purging base brick in the first group of bottom purging base bricks is drilled to form a through hole with a drilling machine, and a bottom purging/powder injection brick is installed in each of the through holes, a gap between the through hole and the bottom purging/powder injection brick is filled with a refractory material, the plurality of bottom purging/powder injection bricks in the plurality of through holes form the first group of bottom purging/powder injection bricks, and then steelmaking is carried out by top oxygen blowing and bottom powder injection;

the bottom purging/powder injection bricks are gradually eroded as the number of converter smelting heat increases, and when the bottom purging/powder injection brick has been eroded to a warning position, a warning signal is issued, at which time the bottom purging/powder injection brick for which the warning is triggered stops powder injection, and a powder transport pipe of the bottom purging/powder injection brick for which the warning is triggered is blocked with a refractory material, an annular gap pipe of the bottom purging/powder injection brick for which the warning is triggered keeps ventilating, and the other bottom purging/powder injection bricks for which no warning is triggered operate normally; when the number of bottom purging/powder injection bricks for which the warning is triggered reaches half the total number of bottom purging/powder injection bricks in the group, all the bottom purging/powder injection bricks in the group stop powder injection, powder supply pipes of all the bottom purging/powder injection bricks in the group are blocked with a refractory material, and annular gap pipes of all the bottom purging/powder injection bricks in the group keep ventilating;

oxygen-blown steelmaking continues to be carried out, frequencies of slag splashing and converter furnace bottom maintenance are increased, and the height of the converter furnace bottom is controlled to raise by 50-100 mm above an initial construction height; then each bottom purging base brick in the second group of bottom purging base bricks is drilled with a drilling machine, the second group of bottom purging/powder injection bricks is installed in the same manner as the first group of bottom purging/powder injection bricks, and after the installation, steelmaking continues to be carried out, and warning for the second group of bottom purging/powder injection bricks is handled in the same manner as the first group of bottom purging/powder injection bricks;

after service of the $N^{th}$ group of bottom purging base bricks ends, the first converter furnace bottom is removed and replaced with a second converter furnace bottom, construction and usage methods of which are the same as those of the first converter furnace bottom; after service of the second converter furnace bottom ends, the second converter furnace bottom is replaced with a third converter furnace bottom; when the refractory material of the converter body has been eroded to a lower limit, a campaign of the powder-bottom-injecting converter ends, converter body reconstruction is carried out, a new first converter furnace bottom is assembled, and the above steps are repeated.

Preferably, before the bottom purging/powder injection brick is installed, the height of the converter furnace bottom needs to be measured, and a length of the bottom purging/powder injection brick is determined according to the height of the converter furnace bottom, to ensure that an upper end surface of the bottom purging/powder injection brick is higher than the converter furnace bottom by 50-100 mm after installation; after installation of each group of bottom purging/powder injection bricks is completed, a layer of coke is placed on the converter furnace bottom, oxygen is blown using the top-blowing oxygen lance to burn the coke, oxygen blowing is stopped when slag adhered on the lining surface has been melted to form a flowing slag, the converter is repeatedly tilted back and forth so that the flowing slag further fills a gap between the bottom purging/powder injection brick and the bottom purging base brick and is adhered around the bottom purging/powder injection brick to form a protective layer, and then steelmaking is carried out by top oxygen blowing and bottom powder injection.

Preferably, an inner diameter of the powder transport pipe of the bottom purging/powder injection brick used on the first converter furnace bottom is D, and inner diameters of the powder transport pipes of the bottom purging/powder injection bricks used on the other converter furnace bottoms are 0.7 D-0.95 D; the bottom purging base bricks constructed on the converter furnace bottom are spaced from each other by a distance of not less than 40 D, and a distance between the bottom purging base brick and a joint between the converter furnace bottom and the converter body is not less than 30 D.

Preferably, the inner diameter D of the powder transport pipe of the bottom purging/powder injection brick is 10-30 mm, and each bottom purging/powder injection brick has a powder injection flow rate of 20-200 kg/min.

Preferably, a plurality of capillary metal tubes are pre-buried inside each bottom purging/powder injection brick, and upper ends of the plurality of capillary metal tubes are respectively buried at different height positions inside each bottom purging/powder injection brick with outlets being blocked by the bottom purging/powder injection brick, and lower ends of the plurality of capillary metal tubes are connected to a gas source; when the bottom purging/powder injection brick is eroded to a height position where an end portion of a capillary metal tube is located, the end portion of the capillary metal tube changes from a blocked state to an unblocked state, gas inside the capillary metal tube flows, a detection system detects an air flow and issues the warning signal, to automatically detect an erosion height of the bottom purging/powder injection brick.

Preferably, N is not less than 2, with each group comprising at least two bottom purging base bricks.

Preferably, a life of the powder-bottom-injecting converter is prolonged from conventionally 1000-3000 heats to 6000-10000 heats by the long-life service method.

The technical solutions provided in the embodiments of the present application at least include the following beneficial effects:

(1) In the present application, a plurality of groups of bottom purging base bricks are pre-buried at the converter furnace bottom, the bottom purging base bricks are spaced from each other by a certain distance to avoid overlapping of erosion pits of the bottom purging/powder injection bricks, and the plurality of groups of bottom purging base bricks are put into use sequentially, thereby prolonging the service life of each converter furnace bottom manyfold.

(2) After the bottom purging/powder injection bricks of the present application are installed, the flowing slag in the converter is used to effectively fill the gap and form an initial protective layer, which helps to prolong the service life of the bottom purging/powder injection bricks and prevent the seepage of molten steel from the gap.

(3) After warning is triggered for a bottom purging/powder injection brick of the present application, there is no need to drill a hole and remove the bottom purging/powder injection brick. Instead, it is only necessary to block the powder transport pipe and keep the annular gap pipe ventilating, and the bottom purging/powder injection brick can continue to be used as an ordinary purging brick, which not only saves the costs of drilling, but also can provide additional stirring for the molten bath.

(4) After the plurality of groups of bottom purging base bricks of the present application have all failed, the powder-bottom-injecting converter can continue its service through hot replacement of the converter furnace bottom as long as the converter body has not been eroded to the lower limit. The optimized design of the positions of the bottom purging base bricks and the powder transport pipes of the bottom purging/powder injection bricks can reduce the damage to the weak joint between the converter furnace bottom and the converter body, to ensure the service life of a new converter furnace bottom.

(5) With the adoption of the present application, the life of the powder-bottom-injecting converter can be increased manyfold, from 1000-3000 heats in the prior art to 6000-10000 heats. Hence, the life of the powder-bottom-injecting converter is as long as that of a conventional converter, and therefore is suitable for use in large-scale productions.

BRIEF DESCRIPTION OF THE DRAWINGS

In order to more clearly explain the technical solutions in the embodiments of the present application, the drawings used in the description of the embodiments will be briefly described below. Obviously, the drawings depicted below are merely embodiments of the present application, and those skilled in the art can obtain other drawings based on these drawings without any creative efforts.

LIST OF REFERENCE NUMERALS

Figure 1:
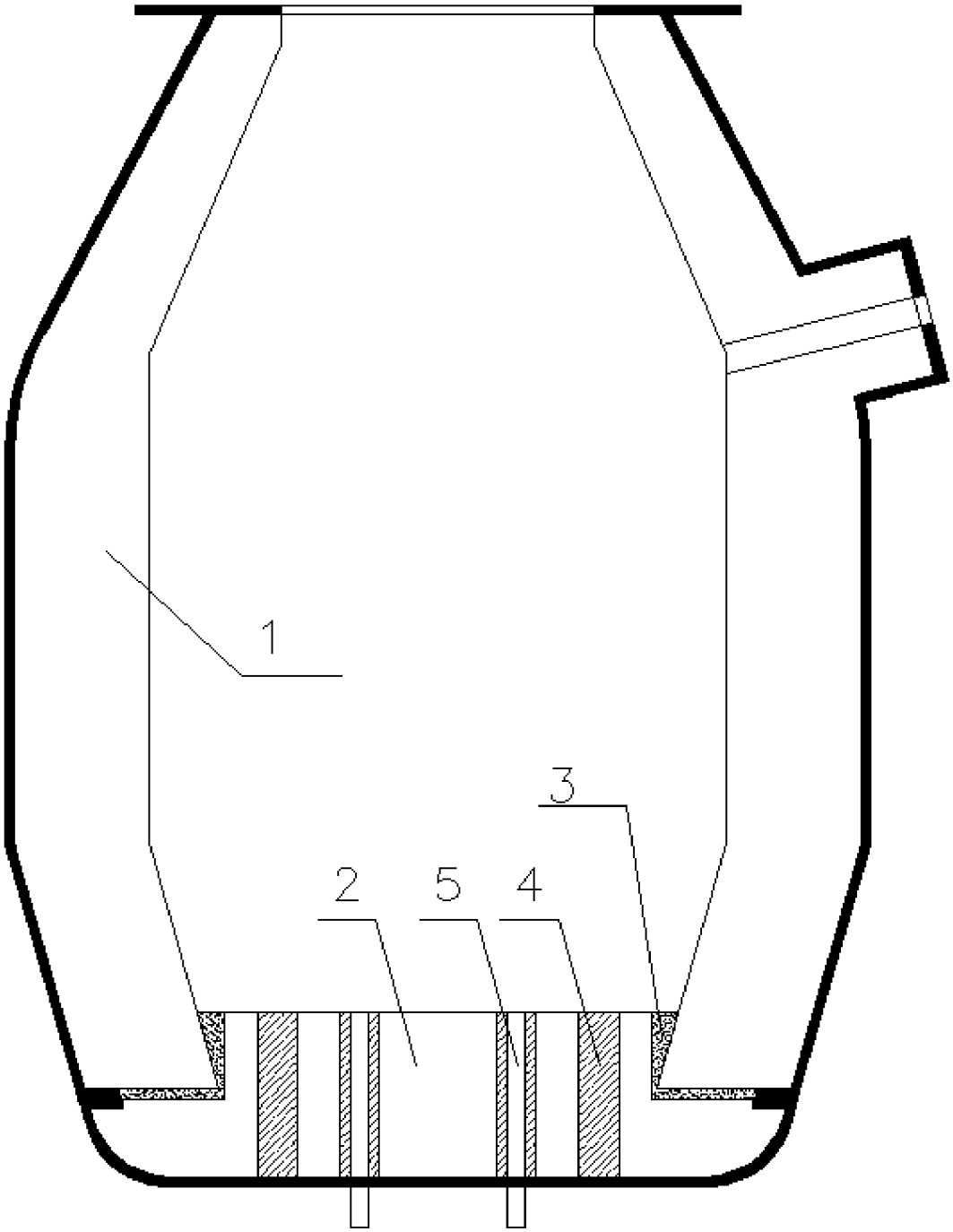
FIG. 1 is a schematic assembled view of a converter body and a converter furnace bottom according to the present application.
Figure 2:
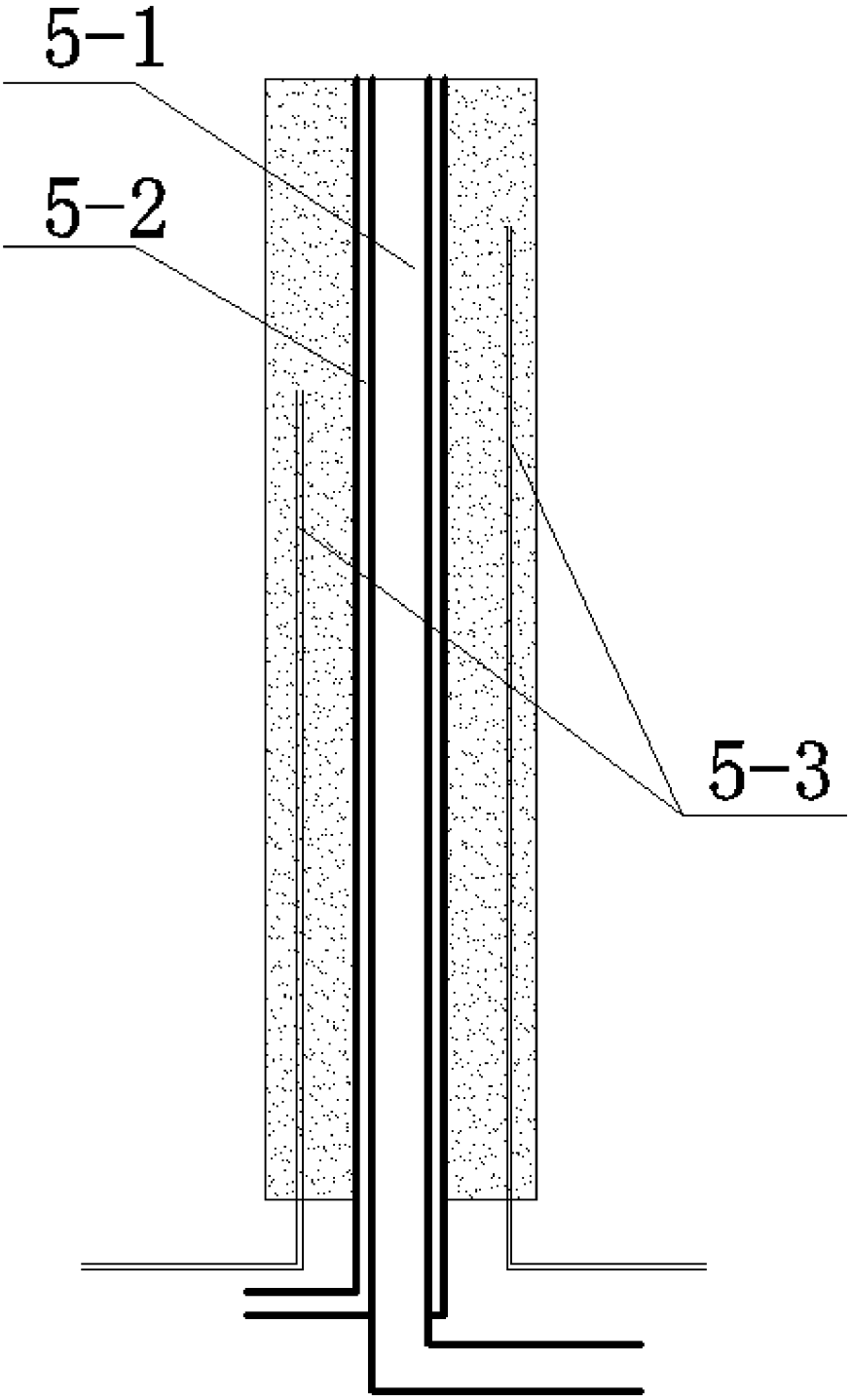
FIG. 2 is a schematic structural view of a bottom purging/powder injection brick according to the present application.
Figure 3:
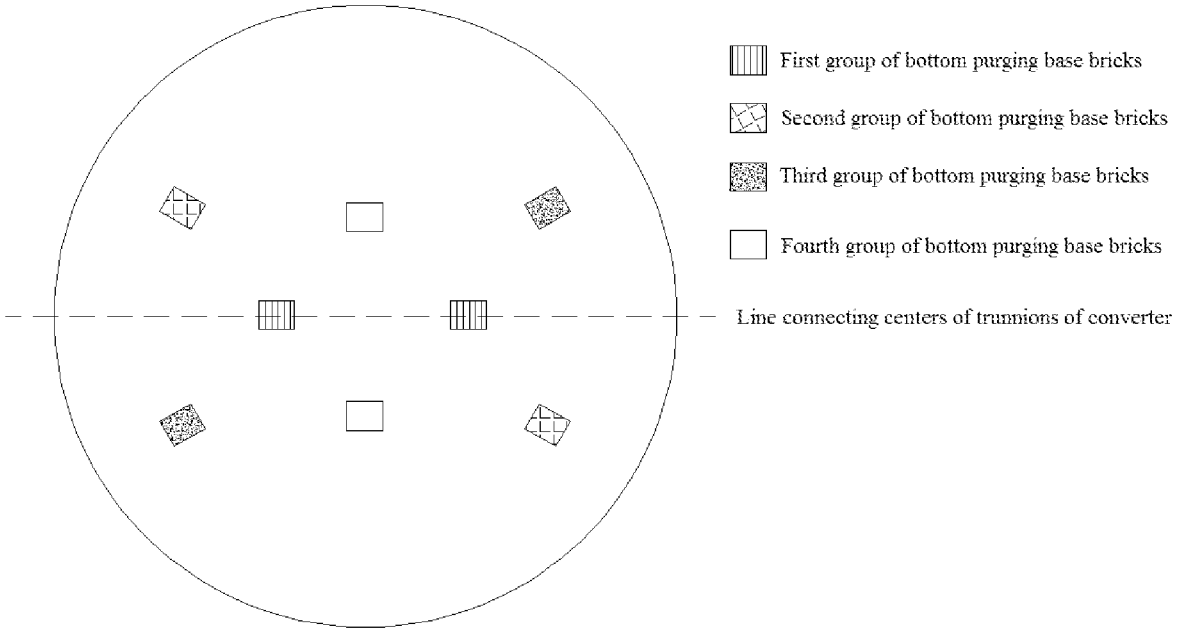
FIG. 3 is a schematic view showing construction of a converter furnace bottom according to Embodiment 1 of the present application.
Figure 4:
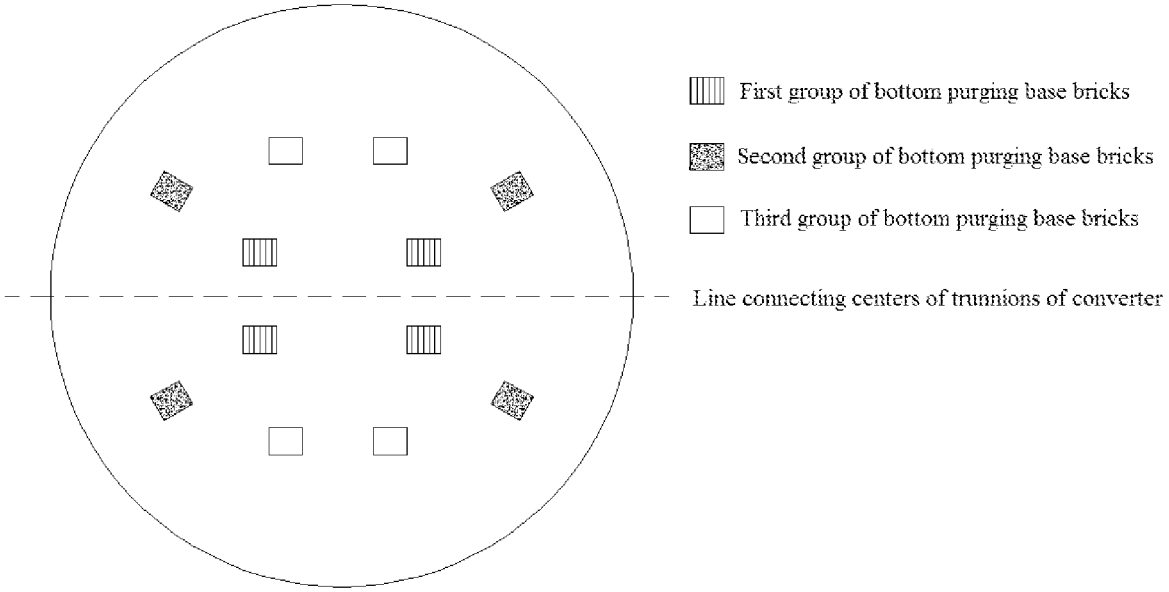
FIG. 4 is a schematic view showing construction of a converter furnace bottom according to Embodiment 2 of the present application.

1—converter body;
2—converter furnace bottom;
3—joint between converter furnace bottom and converter body;
4—bottom purging base brick;
5—bottom purging/powder injection brick;
5-1—powder transport pipe;
5-2—annular gap pipe;
5-3—capillary metal tube.

DETAILED DESCRIPTION OF THE EMBODIMENTS

To make the technical problems, technical solutions, and advantages of the present application clearer, the present application is described in further detail below with reference to the accompanying drawings and specific embodiments.

The present application provides a long-life service method based on collaborative hot replacement of a powder-bottom-injecting converter furnace bottom and a bottom purging brick, characterized in that, the powder-bottom-injecting converter furnace bottom is a plurality of independently removable and replaceable converter furnace bottoms; during construction of the powder-bottom-injecting converter furnace bottom, a first converter furnace bottom is selected, N groups of bottom purging base bricks are preconstructed on the first converter furnace bottom, and the N groups of bottom purging base bricks are solid; after the construction, the first converter furnace bottom is assembled to a converter body, and then oxygen-blown steelmaking is carried out using a top-blowing oxygen lance with a high Mach number and small inclination angle;

after a refractory material of the first converter furnace bottom is properly sintered, each bottom purging base brick in the first group of bottom purging base bricks is drilled to form a through hole with a drilling machine, and a bottom purging/powder injection brick is installed in each of the through holes, a gap between the through hole and the bottom purging/powder injection brick is filled with a refractory material, the plurality of bottom purging/powder injection bricks in the plurality of through holes form the first group of bottom purging/powder injection bricks, and then steelmaking is carried out by top oxygen blowing and bottom powder injection;

the bottom purging/powder injection bricks are gradually eroded as the number of heats of converting increases, and when the bottom purging/powder injection brick has been eroded to a warning position, a warning signal is issued, at which time the bottom purging/powder injection brick for which the warning is triggered stops powder injection, and a powder transport pipe of the bottom purging/powder injection brick for which the warning is triggered is blocked with a refractory material, an annular gap pipe of the bottom purging/powder injection brick for which the warning is triggered keeps ventilating, and the other bottom purging/powder injection bricks for which no warning is triggered operate normally; when the number of bottom purging/powder injection bricks for which the warning is triggered reaches half the total number of bottom purging/powder injection bricks in the group, all the bottom purging/powder injection bricks in the group stop powder injection, powder supply pipes of all the bottom purging/powder injection bricks in the group are blocked with a refractory material, and annular gap pipes of all the bottom purging/powder injection bricks in the group keep ventilating;

oxygen-blown steelmaking continues to be carried out, frequencies of slag splashing and converter furnace bottom maintenance are increased, and the height of the converter furnace bottom is controlled to raise by 50-100 mm above an initial construction height; then each bottom purging base brick in the second group of bottom purging base bricks is drilled with a drilling machine, the second group of bottom purging/powder injection bricks is installed in the same manner as the first group of bottom purging/powder injection bricks, and after the installation, steelmaking continues to be carried out, and warning for the second group of bottom purging/powder injection bricks is handled in the same manner as the first group of bottom purging/powder injection bricks;

after service of the $N^{th}$ group of bottom purging base bricks ends, the first converter furnace bottom is removed and replaced with a second converter furnace bottom, construction and usage methods of which are the same as those of the first converter furnace bottom; after service of the second converter furnace bottom ends, the second converter furnace bottom is replaced with a third converter furnace bottom; when the refractory material of the converter body has been eroded to a lower limit, the service life of the powder-bottom-injecting converter ends, converter body reconstruction is carried out, a new first converter furnace bottom is assembled, and the above steps are repeated.

Particularly, before the bottom purging/powder injection brick is installed, the height of the converter furnace bottom needs to be measured, and a length of the bottom purging/powder injection brick is determined according to the height of the converter furnace bottom, to ensure that an upper end surface of the bottom purging/powder injection brick is higher than the converter furnace bottom by 50-100 mm after installation; after installation of each group of bottom purging/powder injection bricks is completed, a layer of coke is placed on the converter furnace bottom, oxygen is blown using the top-blowing oxygen lance to burn the coke, oxygen blowing is stopped when slag adhered on the lining surface has been melted to form a flowing slag, the converter is repeatedly tilted back and forth so that the flowing slag further fills a gap between the bottom purging/powder injection brick and the bottom purging base brick and is adhered around the bottom purging/powder injection brick to form a protective layer, and then steelmaking is carried out by top oxygen blowing and bottom powder injection.

Particularly, an inner diameter of the powder transport pipe of the bottom purging/powder injection brick used on the first converter furnace bottom is D, and inner diameters of the powder transport pipes of the bottom purging/powder injection bricks used on the other converter furnace bottoms are 0.7 D-0.95 D; the bottom purging base bricks constructed on the converter furnace bottom are spaced from each other by a distance of not less than 40 D, and a distance between the bottom purging base brick and a joint between the converter furnace bottom and the converter body is not less than 30 D.

Particularly, the inner diameter D of the powder transport pipe of the bottom purging/powder injection brick is 10-30 mm, and each bottom purging/powder injection brick has a powder injection flow rate of 20-200 kg/min.

Particularly, a plurality of capillary metal tubes are pre-buried inside each bottom purging/powder injection brick, and upper ends of the plurality of capillary metal tubes are respectively buried at different height positions inside each bottom purging/powder injection brick with outlets being blocked by the bottom purging/powder injection brick, and lower ends of the plurality of capillary metal tubes are connected to a gas source; when the bottom purging/powder injection brick is eroded to a height position where an end portion of a capillary metal tube is located, the end portion of the capillary metal tube changes from a blocked state to an unblocked state, gas inside the capillary metal tube flows, a detection system detects an air flow and issues the warning signal, to automatically detect an erosion height of the bottom purging/powder injection brick.

Particularly, N is not less than 2, with each group comprising at least two bottom purging base bricks.

Particularly, a life of the powder-bottom-injecting converter is prolonged from conventionally 1000-3000 heats to 6000-10000 heats by the long-life service method.

Specifically, the long-life service method based on collaborative hot replacement of a powder-bottom-injecting converter furnace bottom and a bottom purging brick will be illustrated with reference to the following embodiments and the accompanying drawings.

Embodiment 1

The present application was applied to a 120-ton powder-bottom-injecting converter in a steel plant. The converter furnace bottom of the converter can be removed and installed independently. During construction of the converter, 4 groups of bottom purging base bricks were pre-constructed on a first converter furnace bottom, where each group includes 2 bottom purging base bricks, the bottom purging base bricks are spaced from each other by a distance not less than 1000 mm, and distances between the bottom purging base bricks and the joint between the converter furnace bottom and a converter body is not less than 600 mm. After the construction, the first converter furnace bottom was assembled to the converter body, and then oxygen-blown steelmaking was carried out using a top-blowing oxygen lance with a Mach number of 2.10 and an inclination angle of 11.5°.

After 100 heats of converting, a refractory material of the converter furnace bottom has been properly sintered. A first group of bottom purging base bricks was selected, and the bottom purging base bricks were each drilled to form a through hole with a drilling machine. Before the bottom purging/powder injection brick was installed, the height of the converter furnace bottom was measured, and a length of the bottom purging/powder injection brick was determined according to the height of the converter furnace bottom, to ensure that an upper end surface of the bottom purging/powder injection brick is higher than the converter furnace bottom by 50-100 mm after installation. The bottom purging/powder injection brick of which the powder transport pipe has an inner diameter of 20 mm was installed in the through hole of the bottom purging base brick, and the gap therebetween was filled with a refractory material.

After installation of the 2 bottom purging/powder injection bricks was completed, a layer of coke was placed on the converter furnace bottom, oxygen was blown using the top-blowing oxygen lance to burn the coke, oxygen blowing was stopped when slag adhered on the lining surface has been melted to form a flowing slag, the converter was repeatedly tilted back and forth so that the flowing slag filled a gap between the bottom purging/powder injection brick and the bottom purging base brick and was adhered around the bottom purging/powder injection brick to form a protective layer, and then steelmaking was carried out by top oxygen blowing and bottom powder injection. In this case, the Mach number of the top-blowing oxygen lance was 1.98, the inclination angle was 12.5°, the powder injection flow rate of each bottom purging/powder injection brick was 120 kg/min, a maximum powder injection flow rate of 2 bottom purging/powder injection bricks was 240 kg/min, and the carrier gas flow rate was 2700 $Nm^3/h$.

The bottom purging/powder injection bricks were gradually eroded as the number of heats of converting increased. When the number of heats of converting reached 1280, the erosion depth of one of the bottom purging/powder injection bricks reached 400 mm, end portions of capillary metal tubes pre-buried in the bottom purging/powder injection brick were burned through, a warning signal was issued, all the bottom purging/powder injection bricks in the group stopped powder injection, powder supply pipes of all the bottom purging/powder injection bricks in the group were blocked with a refractory material, and annular gap pipes of all the bottom purging/powder injection bricks in the group kept ventilating, where a purging flow rate of the annular gap pipe of each bottom purging/powder injection brick was 20-200 $Nm^3/h$.

Oxygen-blown steelmaking continued to be carried out, frequencies of slag splashing and converter furnace bottom maintenance were increased, and the height of the converter furnace bottom was controlled to raise by 50-100 mm above an initial construction height. Then the second group of bottom purging base bricks was drilled with a drilling machine, the second group of bottom purging/powder injection bricks was installed in the same manner as the first group of bottom purging/powder injection bricks, and after the installation, steelmaking continued to be carried out, and warning for the second group of bottom purging/powder injection bricks was handled in the same manner as the first group of bottom purging/powder injection bricks. After service of the fourth group of bottom purging base bricks ended, the first converter furnace bottom was removed and replaced with a second converter furnace bottom. By this time, a total of 4216 heats of converting had been completed.

Construction and usage methods of the second converter furnace bottom are the same as those of the first converter furnace bottom, and inner diameters of powder transport pipes of bottom purging/powder injection bricks used in the second converter furnace bottom are 18 mm. After 3801 heats of converting using the second converter furnace bottom were completed, it was found that the refractory material of the converter body had been eroded to the lower limit, i.e., a current campaign of the powder-bottom-injecting converter ended. The actual life of the current campaign was 8017 heats.

Embodiment 2

The present application was applied to a 300-ton powder-bottom-injecting converter in a steel plant. The converter furnace bottom of the converter can be removed and installed independently. During construction of the converter, 3 groups of bottom purging base bricks were pre-constructed on a first converter furnace bottom, where each group includes 4 bottom purging base bricks, the bottom purging base bricks are spaced from each other by a distance not less than 1000 mm, and distances between the bottom purging base bricks and the joint between the converter furnace bottom and a converter body is not less than 800 mm. After the construction, the first converter furnace bottom was assembled to the converter body, and then oxygen-blown steelmaking was carried out using a top-blowing oxygen lance with a Mach number of 2.10 and an inclination angle of 14.5°.

After 210 heats of converting, a refractory material of the converter furnace bottom has been properly sintered. A first group of bottom purging base bricks was selected, and the bottom purging base bricks were each drilled to form a through hole with a drilling machine. Before the bottom purging/powder injection brick was installed, the height of the converter furnace bottom was measured, and a length of the bottom purging/powder injection brick was determined according to the height of the converter furnace bottom, to ensure that an upper end surface of the bottom purging/powder injection brick is higher than the converter furnace bottom by 50-100 mm after installation. The bottom purging/powder injection brick of which the powder transport pipe has an inner diameter of 24 mm was installed in the through hole of the bottom purging base brick, and the gap therebetween was filled with a refractory material.

After installation of the 4 bottom purging/powder injection bricks was completed, a layer of coke was placed on the converter furnace bottom, oxygen was blown using the top-blowing oxygen lance to burn the coke, oxygen blowing was stopped when slag adhered on the lining surface has been melted to form a flowing slag, the converter was repeatedly tilted back and forth so that the flowing slag filled a gap between the bottom purging/powder injection brick and the bottom purging base brick and was adhered around the bottom purging/powder injection brick to form a protective layer, and then steelmaking was carried out by top oxygen blowing and bottom powder injection. In this case, the Mach number of the top-blowing oxygen lance was 2.0, the inclination angle was 16°, the powder injection flow rate of each bottom purging/powder injection brick was 150 kg/min, a maximum powder injection flow rate of 4 bottom purging/powder injection bricks was 600 kg/min, and the carrier gas flow rate was 6000 $Nm^3/h$.

The bottom purging/powder injection bricks were gradually eroded as the number of heats of converting increased. When the number of heats of converting reached 1960, the erosion depth of one of the bottom purging/powder injection bricks reached 600 mm, end portions of capillary metal tubes pre-buried in the bottom purging/powder injection brick were burned through, a warning signal was issued, the bottom purging/powder injection brick immediately stopped powder injection, and at the same time, the powder supply pipe of the bottom purging/powder injection brick was blocked with a refractory material, the annular gap pipe of the bottom purging/powder injection brick kept ventilating, and the other bottom purging/powder injection bricks operated normally.

When the number of heats of converting reached 2001, a warning signal was issued for the second bottom purging/powder injection brick, all the bottom purging/powder injection bricks in the group stopped powder injection, the powder supply pipes of all the bottom purging/powder injection bricks in the group were blocked with a refractory material, and the annular gap pipes of all the bottom purging/powder injection bricks in the group kept ventilating, where a purging flow rate of the annular gap pipe of each bottom purging/powder injection brick was 30-300 $Nm^3/h$.

Oxygen-blown steelmaking continued to be carried out, frequencies of slag splashing and converter furnace bottom maintenance were increased, and the height of the converter furnace bottom was controlled to raise by 50-100 mm above an initial construction height. Then the second group of bottom purging base bricks was drilled with a drilling machine, the second group of bottom purging/powder injection bricks was installed in the same manner as the first group of bottom purging/powder injection bricks, and after the installation, steelmaking continued to be carried out, and warning for the second group of bottom purging/powder injection bricks was handled in the same manner as the first group of bottom purging/powder injection bricks. After service of the third group of bottom purging base bricks ended, the first converter furnace bottom was removed and replaced with a second converter furnace bottom. By this time, a total of 5523 heats of converting had been completed.

Construction and usage methods of the second converter furnace bottom are the same as those of the first converter furnace bottom, and inner diameters of powder transport pipes of bottom purging/powder injection bricks used in the second converter furnace bottom are 22 mm. After 4001 heats of converting using the second converter furnace bottom were completed, it was found that the refractory material of the converter body had been eroded to the lower limit, i.e., a current campaign of the powder-bottom-injecting converter ended. The actual life of the current campaign was 9524 heats.

Embodiment 3

The present application was applied to a 350-ton powder-bottom-injecting converter in a steel plant. The converter furnace bottom of the converter can be removed and installed independently. During construction of the converter, 2 groups of bottom purging base bricks were pre-constructed on a first converter furnace bottom, where each group includes 4 bottom purging base bricks, the bottom purging base bricks are spaced from each other by a distance not less than 1200 mm, and distances between the bottom purging base bricks and the joint between the converter furnace bottom and a converter body is not less than 1000 mm. After the construction, the first converter furnace bottom was assembled to the converter body, and then oxygen-blown steelmaking was carried out using a top-blowing oxygen lance with a Mach number of 2.10 and an inclination angle of 15°.

After 300 heats of converting, a refractory material of the converter furnace bottom has been properly sintered. A first group of bottom purging base bricks was selected, and the bottom purging base bricks were each drilled to form a through hole with a drilling machine. Before the bottom purging/powder injection brick was installed, the height of the converter furnace bottom was measured, and a length of the bottom purging/powder injection brick was determined according to the height of the converter furnace bottom, to ensure that an upper end surface of the bottom purging/powder injection brick is higher than the converter furnace bottom by 50-100 mm after installation. The bottom purging/powder injection brick of which the powder transport pipe has an inner diameter of 28 mm was installed in the through hole of the bottom purging base brick, and the gap therebetween was filled with a refractory material.

After installation of the 4 bottom purging/powder injection bricks was completed, a layer of coke was placed on the converter furnace bottom, oxygen was blown using the top-blowing oxygen lance to burn the coke, oxygen blowing was stopped when slag adhered on the lining surface has been melted to form a flowing slag, the converter was repeatedly tilted back and forth so that the flowing slag filled a gap between the bottom purging/powder injection brick and the bottom purging base brick and was adhered around the bottom purging/powder injection brick to form a protective layer, and then steelmaking was carried out by top oxygen blowing and bottom powder injection. In this case, the Mach number of the top-blowing oxygen lance was 2.0, the inclination angle was 16.5°, the powder injection flow rate of each bottom purging/powder injection brick was 180 kg/min, a maximum powder injection flow rate of 4 bottom purging/powder injection bricks was 720 kg/min, and the carrier gas flow rate was 8000 $Nm^3/h$.

The bottom purging/powder injection bricks were gradually eroded as the number of heats of converting increased. When the number of heats of converting reached 1780, the erosion depth of one of the bottom purging/powder injection bricks reached 600 mm, end portions of capillary metal tubes pre-buried in the bottom purging/powder injection brick were burned through, a warning signal was issued, the bottom purging/powder injection brick immediately stopped powder injection, and at the same time, the powder supply pipe of the bottom purging/powder injection brick was blocked with a refractory material, the annular gap pipe of the bottom purging/powder injection brick kept ventilating, and the other bottom purging/powder injection bricks operated normally.

When the number of heats of converting reached 1920, a warning signal was issued for the second bottom purging/powder injection brick, all the bottom purging/powder injection bricks in the group stopped powder injection, the powder supply pipes of all the bottom purging/powder injection bricks in the group were blocked with a refractory material, and the annular gap pipes of all the bottom purging/powder injection bricks in the group kept ventilating, where a purging flow rate of the annular gap pipe of each bottom purging/powder injection brick was 40-400 $Nm^3/h$.

Oxygen-blown steelmaking continued to be carried out, frequencies of slag splashing and converter furnace bottom maintenance were increased, and the height of the converter furnace bottom was controlled to raise by 50-100 mm above an initial construction height. Then the second group of bottom purging base bricks was drilled with a drilling machine, the second group of bottom purging/powder injection bricks was installed in the same manner as the first group of bottom purging/powder injection bricks, and after the installation, steelmaking continued to be carried out, and warning for the second group of bottom purging/powder injection bricks was handled in the same manner as the first group of bottom purging/powder injection bricks. After service of the third group of bottom purging base bricks ended, the first converter furnace bottom was removed and replaced with a second converter furnace bottom. By this time, a total of 3790 heats of converting had been completed.

Construction and usage methods of the second converter furnace bottom are the same as those of the first converter furnace bottom, and inner diameters of powder transport pipes of bottom purging/powder injection bricks used in the second converter furnace bottom are 26 mm. After 3350 heats of converting using the second converter furnace bottom were completed, it was found that the refractory material of the converter body had been eroded to the lower limit, i.e., a current campaign of the powder-bottom-injecting converter ended. The actual life of the current campaign was 7140 heats.

Embodiment 4

The present application was applied to a 50-ton powder-bottom-injecting converter in a steel plant. The converter furnace bottom of the converter can be removed and installed independently. During construction of the converter, 3 groups of bottom purging base bricks were pre-constructed on a first converter furnace bottom, where each group includes 2 bottom purging base bricks, the bottom purging base bricks are spaced from each other by a distance not less than 1000 mm, and distances between the bottom purging base bricks and the joint between the converter furnace bottom and a converter body is not less than 450 mm. After the construction, the first converter furnace bottom was assembled to the converter body, and then oxygen-blown steelmaking was carried out using a top-blowing oxygen lance with a Mach number of 2.02 and an inclination angle of 10.5°.

After 100 heats of converting, a refractory material of the converter furnace bottom has been properly sintered. A first group of bottom purging base bricks was selected, and the bottom purging base bricks were each drilled to form a through hole with a drilling machine. Before the bottom purging/powder injection brick was installed, the height of the converter furnace bottom was measured, and a length of the bottom purging/powder injection brick was determined according to the height of the converter furnace bottom, to ensure that an upper end surface of the bottom purging/powder injection brick is higher than the converter furnace bottom by 50-100 mm after installation. The bottom purging/powder injection brick of which the powder transport pipe has an inner diameter of 14 mm was installed in the through hole of the bottom purging base brick, and the gap therebetween was filled with a refractory material.

After installation of the 2 bottom purging/powder injection bricks was completed, a layer of coke was placed on the converter furnace bottom, oxygen was blown using the top-blowing oxygen lance to burn the coke, oxygen blowing was stopped when slag adhered on the lining surface has been melted to form a flowing slag, the converter was repeatedly tilted back and forth so that the flowing slag filled a gap between the bottom purging/powder injection brick and the bottom purging base brick and was adhered around the bottom purging/powder injection brick to form a protective layer, and then steelmaking was carried out by top oxygen blowing and bottom powder injection. In this case, the Mach number of the top-blowing oxygen lance was 1.98, the inclination angle was 11.5°, the powder injection flow rate of each bottom purging/powder injection brick was 40 kg/min, a maximum powder injection flow rate of 2 bottom purging/powder injection bricks was 80 kg/min, and the carrier gas flow rate was 1000 $Nm^3/h$.

The bottom purging/powder injection bricks were gradually eroded as the number of heats of converting increased. When the number of heats of converting reached 1160, the erosion depth of one of the bottom purging/powder injection bricks reached 350 mm, end portions of capillary metal tubes pre-buried in the bottom purging/powder injection brick were burned through, a warning signal was issued, all the bottom purging/powder injection bricks in the group stopped powder injection, powder supply pipes of all the bottom purging/powder injection bricks in the group were blocked with a refractory material, and annular gap pipes of all the bottom purging/powder injection bricks in the group kept ventilating, where a purging flow rate of the annular gap pipe of each bottom purging/powder injection brick was 15-150 $Nm^3/h$.

Oxygen-blown steelmaking continued to be carried out, frequencies of slag splashing and converter furnace bottom maintenance were increased, and the height of the converter furnace bottom was controlled to raise by 50-100 mm above an initial construction height. Then the second group of bottom purging base bricks was drilled with a drilling machine, the second group of bottom purging/powder injection bricks was installed in the same manner as the first group of bottom purging/powder injection bricks, and after the installation, steelmaking continued to be carried out, and warning for the second group of bottom purging/powder injection bricks was handled in the same manner as the first group of bottom purging/powder injection bricks. After service of the third group of bottom purging base bricks ended, the first converter furnace bottom was removed and replaced with a second converter furnace bottom. By this time, a total of 3179 heats of converting had been completed.

Construction and usage methods of the second converter furnace bottom are the same as those of the first converter furnace bottom, and inner diameters of powder transport pipes of bottom purging/powder injection bricks used in the second converter furnace bottom are 13 mm. After 2939 heats of converting using the second converter furnace bottom were completed, the service of all the three groups of bottom purging base bricks of the second converter furnace bottom had ended, and the second converter furnace bottom was removed and replaced with a third converter furnace bottom. Construction and usage methods of the third converter furnace bottom are the same as those of the first converter furnace bottom, and inner diameters of powder transport pipes of bottom purging/powder injection bricks used in the third converter furnace bottom are 13 mm. After 2691 heats of converting using the third converter furnace bottom were completed, it was found that the refractory material of the converter body had been eroded to the lower limit, i.e., a current campaign of the powder-bottom-injecting converter ended. The actual life of the current campaign was 8809 heats.

Based on the above, the technical solutions provided in the embodiments of the present application at least include the following beneficial effects:

(1) In the present application, a plurality of groups of bottom purging base bricks are pre-buried at the converter furnace bottom, the bottom purging base bricks are spaced from each other by a certain distance to avoid overlapping of erosion pits of the bottom purging/powder injection bricks, and the plurality of groups of bottom purging base bricks are put into use sequentially, thereby prolonging the service life of each converter furnace bottom manyfold.

(2) After the bottom purging/powder injection bricks of the present application are installed, the flowing slag in the converter is used to effectively fill the gap and form an initial protective layer, which helps to prolong the service life of the bottom purging/powder injection bricks and prevent the seepage of molten steel from the gap.

(3) After warning is triggered for a bottom purging/powder injection brick of the present application, there is no need to drill a hole and remove the bottom purging/powder injection brick. Instead, it is only necessary to block the powder transport pipe and keep the annular gap pipe ventilating, and the bottom purging/powder injection brick can continue to be used as an ordinary purging brick, which not only saves the costs of drilling, but also can provide additional stirring for the molten bath.

(4) After the plurality of groups of bottom purging base bricks of the present application have all failed, the powder-bottom-injecting converter can continue its service through hot replacement of the converter furnace bottom as long as the converter body has not been eroded to the lower limit. The optimized design of the positions of the bottom purging base bricks and the powder transport pipes of the bottom purging/powder injection bricks can reduce the damage to the weak joint between the converter furnace bottom and the converter body, to ensure the service life of a new converter furnace bottom.

(5) With the adoption of the present application, the life of the powder-bottom-injecting converter can be increased manyfold, from 1000-3000 heats in the prior art to 6000-10000 heats. Hence, the life of the powder-bottom-injecting converter is as long as that of a conventional converter, and therefore is suitable for use in large-scale projects.

While preferred embodiments of the present application have been described above, the present application is not limited thereto. It should be appreciated that some improvements and modifications can be made by those skilled in the art without departing from the technical principles of the present application, which are also contemplated to be within the scope of the present application.

What is claimed is:

1. A powder-bottom-injecting converter comprising:

a converter body;

a detection system configured to detect an air flow and issue an erosion warning signal; and a plurality of independently removable converter bottoms, a first converter bottom of the plurality of the independently removable converter bottoms is assembled on the converter body, each of the plurality of the independently removable converter bottoms comprises:

a first group of purging base bricks, wherein each of the purging base bricks in the first group comprises a through hole, and a plurality of bottom purging/powder injection bricks each installed in a corresponding through hole, wherein each of the bottom purging/powder injection bricks comprises:

a powder transport pipe, configured for purging/powder injection when steelmaking;

an annular gap pipe, configured for ventilating; and a plurality of capillary metal tubes buried inside each of the bottom purging/powder injection bricks, with respective upper ends of the capillary metal tubes buried at different height positions inside each of the bottom purging/powder injection bricks and blocked by each of the bottom purging/powder injection bricks, and respective lower ends of the capillary metal tubes connected to a gas source; and when each of the bottom purging/powder injection bricks is eroded to a height where the respective upper ends of the capillary metal tubes are located, the capillary metal tubes are exposed from a blocked state to an unblocked state, and an air flow inside the capillary metal tubes is detected by the detection system and an erosion warning signal is issued by the detection system in response to the detected air flow inside the capillary metal tubes.

2. The powder-bottom-injecting converter according to claim 1, wherein an upper end surface of each of the bottom purging/powder injection bricks is higher than the first converter bottom by 50-100 mm.

3. The powder-bottom-injecting converter according to claim 1, wherein an inner diameter D of the powder transport pipe is 10-30 mm.

4. The powder-bottom-injecting converter according to claim 1, wherein each of the plurality of the independently removable converter bottoms further comprises a second group of the purging base bricks, wherein each of the purging base bricks in the second group comprises a through hole, and a plurality of bottom purging/powder injection bricks each installed in a corresponding through hole;

when the erosion warning signal in the first group of the purging base bricks is issued, the first group of the purging base bricks switches to the second group of the purging base bricks.

* * * * *